United States Patent [19]

Casares

[11] 4,266,536

[45] May 12, 1981

[54] MASSAGING DEVICE FOR BACKS

[76] Inventor: Robert Casares, 15040 Leffingwell, Apt. 53, La Mirada, Calif. 90638

[21] Appl. No.: 106,442

[22] Filed: Dec. 26, 1979

[51] Int. Cl.[3] ..... A61H 15/00

[52] U.S. Cl. ..... 128/57

[58] Field of Search ..... 128/57, 62 R, 67, 32; 15/143 R, 210, 110

[56] References Cited

U.S. PATENT DOCUMENTS

| | | | |
|---|---|---|---|
| 1,533,528 | 4/1925 | Weaver | 128/57 |
| 1,612,343 | 12/1926 | Amussen | 128/67 |
| 2,441,686 | 5/1948 | Cohen | 128/57 |
| 2,477,666 | 8/1949 | Smallen | 128/67 |
| 3,856,002 | 12/1974 | Matsumoto | 128/67 |

*Primary Examiner*—John D. Yasko

*Attorney, Agent, or Firm*—Edgar W. Averill, Jr.

[57] ABSTRACT

A back massager capable of massaging the user's back without assistance. The massager has a curved shaft having a handle near the first end and a second handle positioned at an intermediate point between the first and second ends of the shaft. The shaft is curved and has roller means affixed at the second end thereof.

5 Claims, 4 Drawing Figures

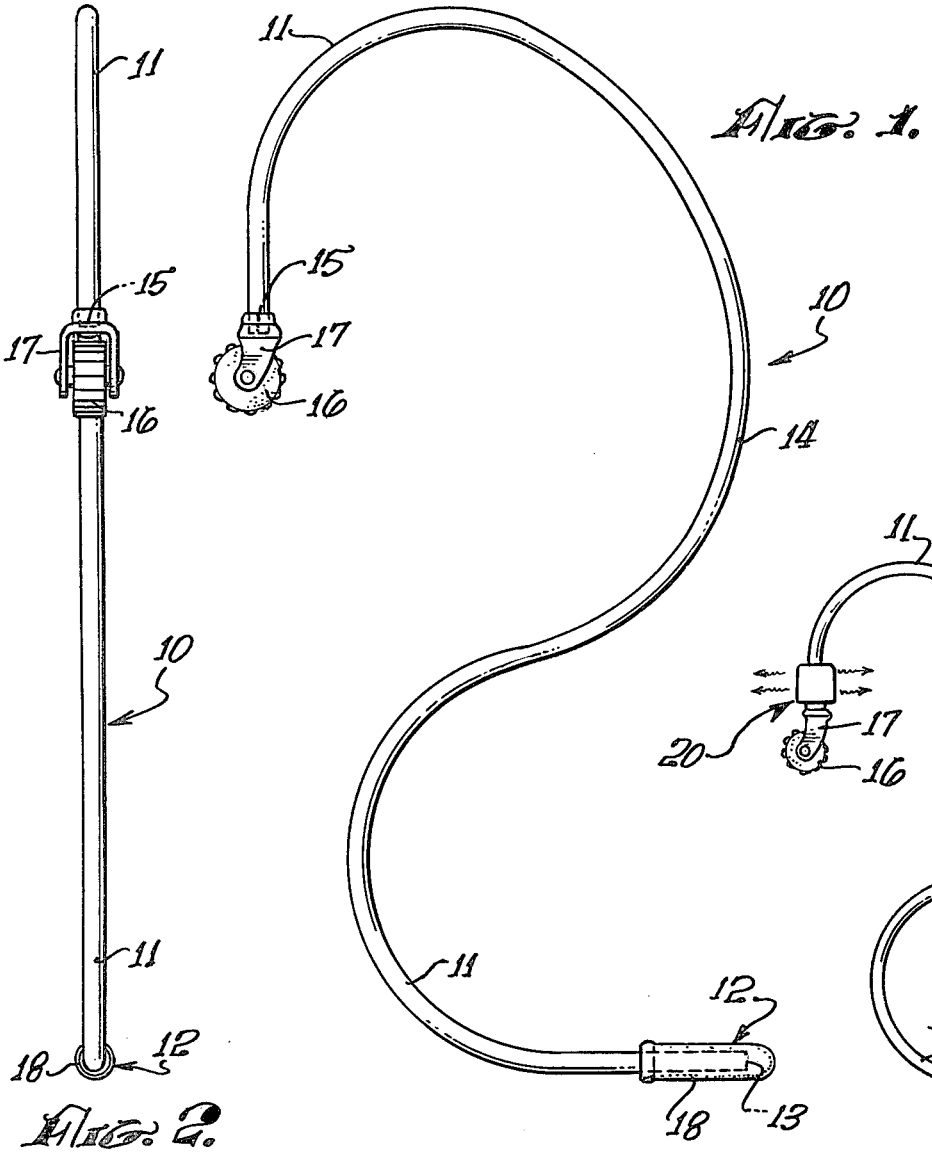
FIG. 1.
FIG. 2.
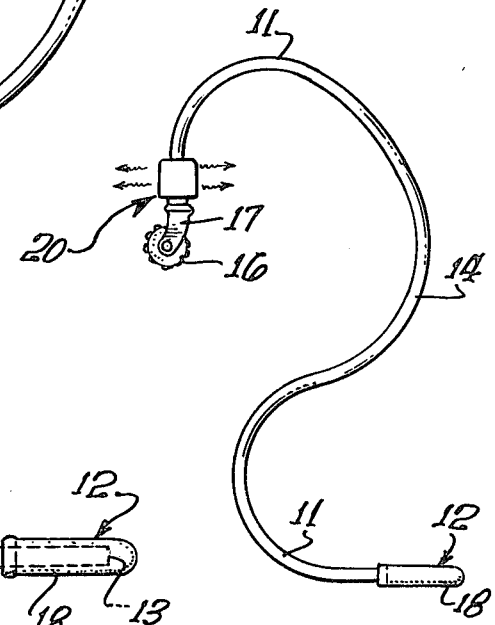
FIG. 4.
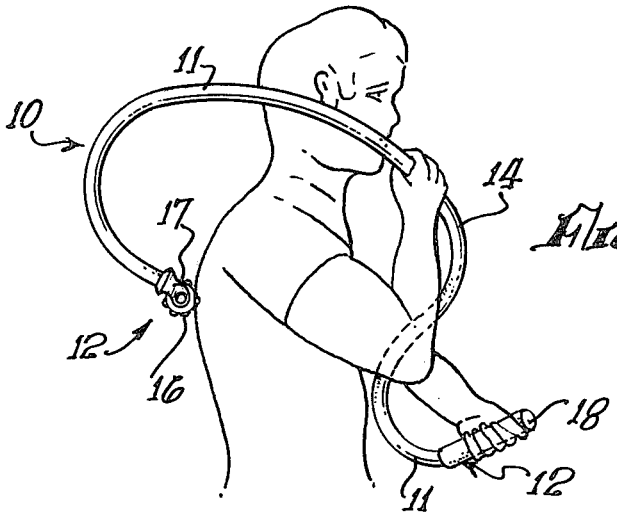
FIG. 3.

MASSAGING DEVICE FOR BACKS

BACKGROUND OF THE DISCLOSURE

The field of the invention is massaging devices, and the invention relates more specifically to devices useful for massaging the user's back. The benefit and comfort of a back massager is widely recognized and such massages administered by a masseur masseuse have been known for centuries. Various massaging devices utilizing have also been known for many years and the following U.S. Pat. Nos. are examples thereof: D123,662, 1,908,051 and D185,246.

The area adjacent one's spine has been recognized as an important area for stimulation or massage for the purpose of improving the functioning of various internal organs of the body. A discussion of this theory is contained in the U.S. Pat. No. 3,750,654. Unfortunately, this area of the back is difficult to reach without the assistance of a masseur. The device disclosed in the aforementioned U.S. Pat. No. 3,750,654 places a great deal of weight on this area during massaging and as shown particularly in FIG. 4*b* of the drawings. The amount of weight is preferably adjustable by the user and should not be dependent merely on the weight of the user.

There is therefore a need for a massaging device which can be used by the user acting alone and which is capable of massaging the user's back particularly along both sides of the user's spine.

Many massaging devices for use on a user's back can only be used when the user's arms or at least one arm is raised. The very raising of the arm tenses many of the muscles which are to be massaged particularly the trapezious muscles thereby retarding or eliminating much of the beneficial effect of the massage namely, to increase circulation. When the muscle along the sides of the user's spine are not relaxed, the massage is limited to the surface area and is not as effective as a massage given while the user's elbows are in a downward position.

SUMMARY OF THE INVENTION

The invention is for a massager useful for massaging the user's back. The massager has a curved shaft having a first end and a second end, the first end having a first handle portion positioned adjacent thereto. The shaft has a radius of curvature between about 8 and 32 inches and is sufficiently long so that the second end of the shaft points about to the first end thereof. The shaft also has a second handle position located intermediate the first and second ends of the shaft. Roller means are affixed at the second end of the shaft whereby the user may hold the handle portions of the shaft and readily manipulate the roller means along his spine.

BRIEF DESCRIPTION OF THE DRAWINGS

FIG. 1 is a side elevational view of the back massager of the present invention.

FIG. 2 is a front elevational view of the back massager of FIG. 1.

FIG. 3 is a reduced side elevational view of the back massager of FIG. 1 being manipulated by a user.

FIG. 4 is a reduced side elevational view of a modified form of the massager of FIG. 1.

DESCRIPTION OF THE PREFERRED EMBODIMENTS

A back massager is shown in side view in FIG. 1 and indicated generally by reference character 10. Massager 10 has a curved shaft 11 which has a first handle portion 12 located near the first end 13 of shaft 11. A second handle portion 14 is located near the middle of shaft 11. Shaft 11 terminates at second end 15 which has a caster means 17 which pivotaly holds a roller 16.

The caster means and roller is also shown in FIG. 2 of the drawings and is very useful in facilitating the use of the massager of the present invention. Roller 16 may be knurled or have a smooth outer surface. A handle member such as handle member 18 may be positioned over end 13 of the shaft. A handle may also be added at area 14 but this is not essential to the practice of the present invention.

A modified form of the present invention is shown in FIG. 4 where a vibrator 20 is positioned near the second end 15 of shaft 11. The addition of a vibrator can increase the massaging action of the present device although such addition is not essential or necessary for many users.

The massager is shown in use in FIG. 3 which illustrates an important feature of the present invention. That is, the massager 10 can be used without raising the user's elbows which would be necessary with a massager with a lesser curvature. The raising of one's arms and particularly one's elbows tends to tighten several important back muscles such as the trapezious muscles as well as the major and minor rhomboid muscles. Also, raising one's elbows typically is associated with a turning of the back and concomitant sideways curving of the spinal cord. Both of these results tend to reduce the benefit of the massage and therefore the ability of the device of the present invention to permit massage while the back is straight and the elbows are held downwardly constitutes an important advantage thereof. Also, as shown in FIG. 3, the shaft 11 is almost normal with respect to the user's back. This permits the caster 17 to rotate and remain in a rotatable position as the roller 16 moves along the user's back.

In order to provide a massager which has the aforementioned benefit, the radius of curvature of the shaft must be sufficient so that the roller 16 may be positioned along the back while being manipulated in front of the user with the elbows in a downward and relaxed position. The radius of curvature is indicated by the letters $r_1$ and $r_2$ in FIG. 1 of the drawings. While the shaft need not form a perfect circular arc, the radius of curvature should be equivalent to a radius of curvature of between 8 and 32 inches from the handle portion 14 to a point about 6 inches from roller 16. A curvature of about 18 inches has been found preferable. It would of course be possible to position the roller in the desired location shown in FIG. 3 by providing a shaft having relatively straight portions and several sharply curved portions, but the net effect should be equivalent to a radius of curvature between the above stated limits.

The second handle portion 14 is located in the middle area of shaft 11 so that a considerable amount of control of pressure may be exerted by the second hand.

The shaft should be fabricated from a member which has sufficient strength to exert massaging force on the back by manipulation of the front end thereof. $\frac{3}{4}$ inch diameter steel tubing has been found useful, and other material such as polyvinyl chloride thick-walled tubing, aluminum tubing or stainless steel tubing could alternatively be used. The wheel 16 should have a diameter of from between one to four inches with about two inches being ideal. The material of construction of the wheel is not critical and materials such as rubber, wood or plastics such as nylon, polyvinyl chloride or ABS could be used. It is beneficial to form the shaft in two removable portions so that it can be disassembled for transportation.

The present embodiments of this invention are thus to be considered in all respects as illustrative and not restrictive; the scope of the invention being indicated by the appended claims rather than by the foregoing description. All changes which come within the meaning and range of equivalency of the claims therefore are intended to be embraced therein.

I claim:

1. A massager useful for massaging the user's back vertically along the user's spine, said massager comprising:

a curved shaft having a first end and a second end, said first end having a first handle portion positioned adjacent thereto, said shaft having a first curved portion forming a fulcrum for resting against the user's front side, said shaft extending to a second curved portion in the reverse direction with respect to the first curved portion having a radius of curvature between about 8 and 32 inches and being sufficiently long so that the shaft may pass over the user's shoulder and reach the upper and lower part of the user's spine and extending sufficiently so that the second end of the shaft is positioned about normal to the back while the first end may be held by the user with the user's elbows in a lowered position, such shaft having a second handle portion located intermediate said first and second ends; and a roller means affixed at the second end of the shaft whereby the user may hold the handle portions of said shaft and readily manipulate said roller means along his spine while keeping his elbows in a downward position and using his front side as a rest for the fulcrum.

2. The massager of claim 1 wherein said roller means is held in caster means affixed to said second end of the shaft.

3. The massager of claim 1 wherein said roller means is approximately two inches in diameter.

4. The massager of claim 1 wherein said radius of curvature is approximately 18 inches.

5. The massager of claim 1 further including vibrator means positioned along said shaft near the second end thereof.

* * * * *